US006805086B2

(12) United States Patent
Kawai

(10) Patent No.: US 6,805,086 B2
(45) Date of Patent: Oct. 19, 2004

(54) IGNITION COIL APPARATUS FOR ENGINE

(75) Inventor: Kazuhide Kawai, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/638,492

(22) Filed: Aug. 12, 2003

(65) Prior Publication Data

US 2004/0045540 A1 Mar. 11, 2004

(30) Foreign Application Priority Data

Sep. 6, 2002 (JP) ..... 2002-261498

(51) Int. Cl.[7] ..... F02P 3/02

(52) U.S. Cl. ..... 123/169 PA; 123/635; 123/647; 123/143 C

(58) Field of Search ..... 123/169 PA, 634, 123/635, 647, 143 C

(56) References Cited

U.S. PATENT DOCUMENTS 5,109,828 A * 5/1992 Tagami et al. ..... 123/635
6,427,674 B1 * 8/2002 Wylin ..... 123/634
6,543,430 B2 * 4/2003 Moga et al. ..... 123/634
6,622,711 B1 * 9/2003 Skinner et al. ..... 123/634
6,655,368 B2 * 12/2003 Wada ..... 123/635
6,675,786 B2 * 1/2004 Tsunenaga et al. ..... 123/635
2004/0123852 A1 * 7/2004 Tsunenaga et al. ..... 123/635

FOREIGN PATENT DOCUMENTS

JP A-5-26144 2/1993
JP A-9-250437 9/1997

* cited by examiner

*Primary Examiner*—Hai Huynh
(74) *Attorney, Agent, or Firm*—Nixon & Vanderhye P.C.

(57) ABSTRACT

Plural ignition coils are inserted into corresponding plug holes. Each coil-head of the ignition coil is received by a holder. The coil-head is pressed by a base plate toward the engine. The holder has hooking claws. The base plate has hooking slots to movably engage with the hooking claws, so that relative position between the ignition coils and the plug holes can be adjusted. In case one ignition coil fails, the disabled ignition coil can be replaced individually. A first connector is formed on the coil-head, and a second connector is formed on the holder. The second connector is connected with the first connector when the holder is engaged with the ignition coil at one time. Thus, assembly work process can be reduced.

14 Claims, 5 Drawing Sheets

IGNITION COIL APPARATUS FOR ENGINE

CROSS REFERENCE TO RELATED APPLICATION

This application is based on and incorporates herein by reference Japanese Patent Application No. 2002-261498 filed on Sep. 6, 2002.

FIELD OF THE INVENTION

The present invention relates to an ignition coil apparatus and an engine using the ignition coil apparatus.

BACKGROUND OF THE INVENTION

In automotive engines, ignition coils are attached to each cylinder respectively, and are fixed by individual bolts. An ECU and a battery are wired with the ignition coils via each connector one by one. Subsequently, the exposed ignition coils and wiring cords are covered with other member.

However, conventional ignition coil apparatus has many assembly parts, and its assembly work takes much man-power. In order to reduce assembly man-power, it is proposed to integrate plural ignition coils into one piece as an ignition coil apparatus. As shown in FIG. 5, this ignition coil apparatus 51 is structured so that plural ignition coils 52 are arranged in predetermined interval to correspond with each plug hole 5*b* of an engine head cover 5, and molded integrally on a base plate 53 with resin. The ignition coil apparatus 51 is attached on the head cover 5 so that each ignition coil 52 is inserted into the corresponding plug hole 5*b* coaxially. The ignition coil apparatus 51 is fixed to the engine by bolts 53*d*.

However, the above ignition coil apparatus 51 have to be manufactured precisely so that all center distances between neighboring plug holes 5*b* (plug hole pitches), and center distances between neighboring coils 52 (coil pitches) exactly match. Otherwise, the integrated ignition coils 52 cannot be inserted coaxially into the corresponding plug holes 5*b*. Furthermore, when even one ignition coil 52 fails, the entire ignition coil apparatus 51 have to be replaced with another complete set, so repair work costs high.

SUMMARY OF THE INVENTION

In view of the foregoing problems, it is an object of the present invention to provide a simply structured ignition coil apparatus which can be attached on an engine without misalignment. Each ignition coil can be easily replaced individually, and electrical connection can be performed easily.

In the present invention, the ignition coil apparatus comprises ignition coils, holders and a base plate. Each ignition coil includes a body portion (coil-body) and a head portion (coil-head). The coil-body is inserted into a corresponding plug hole of the engine head cover. The coil-head, which is on the coil-body, is a larger diametrical unit than the coil-body. The ignition coil is hooked on the holder by its coil-head, and is supported by the holder from downward, and is pressed by a base plate from upward onto a lower engine head cover. The holder hooks on the base plate loosely, restricting the inserted coil-body with play.

The base plate has flat recesses which receive the upper section of the coil-heads. Each recess is larger than the coil-head in diameter. The recessed peripheral surface restricts displacement of the coil-head with clearance. During assembly work, by sliding of the coil-head within the recess, alignment between the ignition coil and the plug hole can be adjusted easily. That is, the manufacturing precision of plug hole pitch can be eased. The ignition coils are adjustable on the base plate, therefore the ignition coils do not have to be mounted on the base plate precisely.

Plural ignition coils and the base plate can be installed on the engine head cover all together. On the contrary, Individual ignition coil can be replaced by detaching of the holder.

A connector on the coil-head can be easily fitted into a connector on the holder. When the holder is set on the coil-head, and is snap-fitted on the base plate, electrical connection is performed at one time.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

Figure 1:
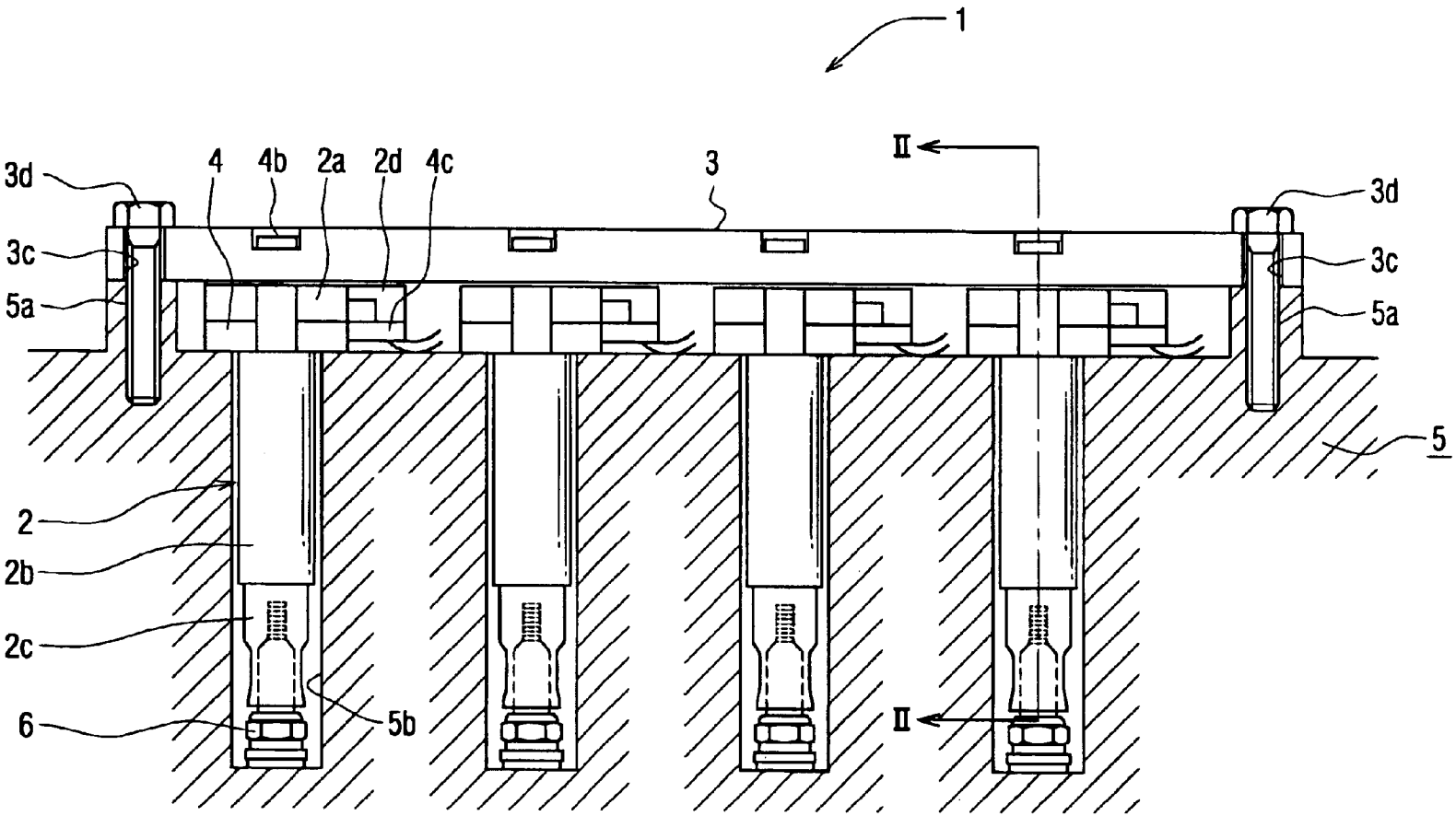
FIG. 1 is an overall cross-sectional side view of an ignition coil apparatus according to an embodiment of the present invention, the apparatus being shown as mounted on an engine cover.

Referring to FIG. 1, an ignition coil apparatus 1 comprises plural stick-shaped ignition coils 2, plural resinous holders 4 and longitudinal flat base plate 3. In case of a four-cylinder engine, the ignition coil apparatus 1 has four ignition coils 2 and four holders 4. Each ignition coil 2 accommodates electric circuits to supply high voltage to each ignition plug 6 fitted in an engine head cover 5. The electric circuits are molded in non-conductive resinous inner case (not shown).

The base plate 3, which is made of non-conductive resin, is set on the engine head cover 5. The base plate 3 has two bolt insertion holes 3*c* at both longitudinal ends thereof. At the bolt insertion holes 3*c*, two mounting bolts 3*d* are set. The mounting bolts 3*d* are screwed into screw holes 5*a* of the engine head cover 5. Thus, the base plate 3 is rigidly fixed on the engine head cover 5. The base plate 3 contacts top end surfaces of the ignition coils 2, and presses the ignition coils 2 toward the engine head cover 5.

Each ignition coil 2 comprises a column-shaped coil-head 2*a* and a cylindrical coil-body 2*b* and a cylindrical plug-cap 2*c*. The coil-head 2*a* is a top end of the ignition coil 2, and the coil-body 2*b* is under the coil-head 2*a*, and the plug-cap 2*c* is positioned under the coil-body 2*b* as a bottom end.

Figure 2:
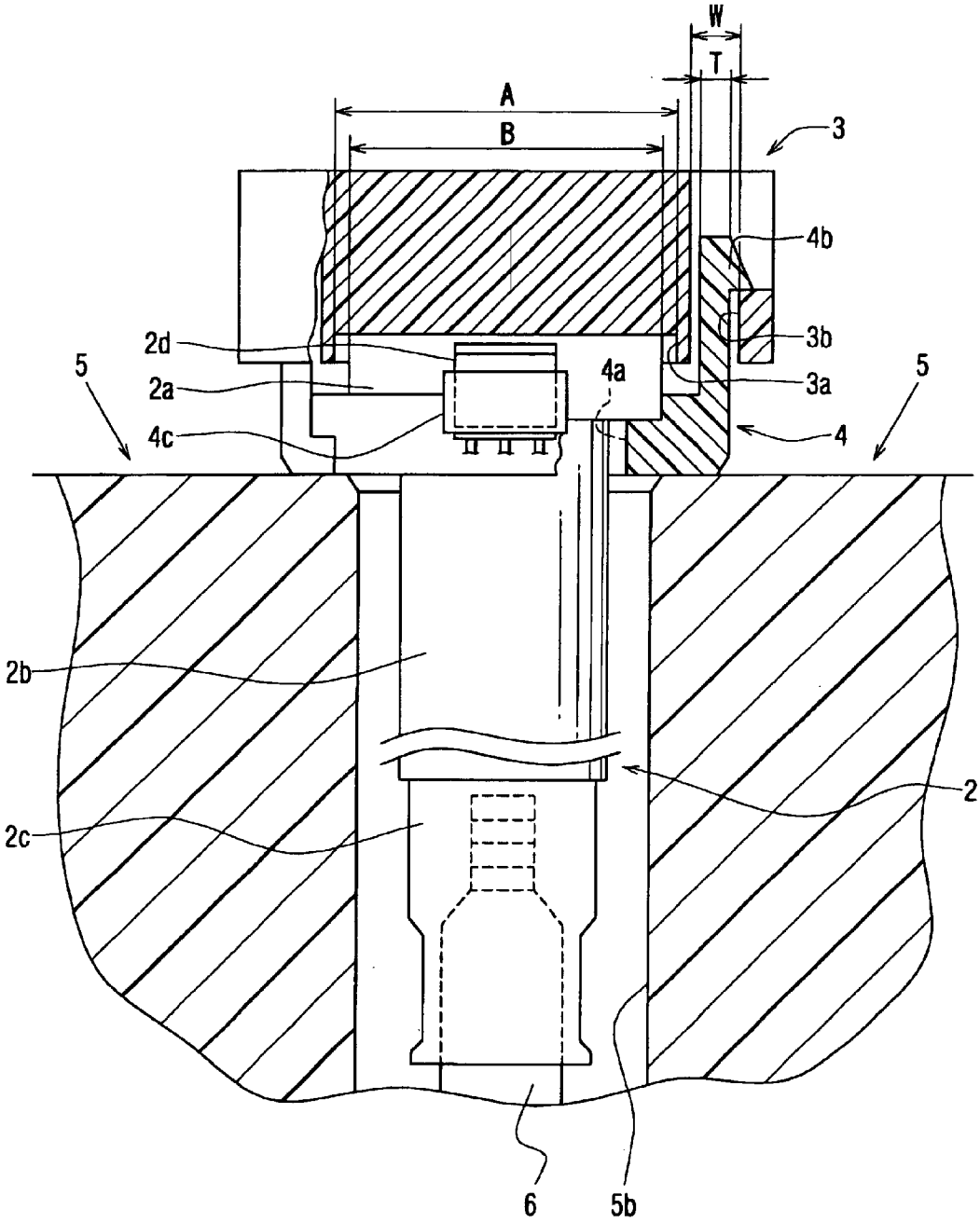
FIG. 2 is an enlarged partially cross-sectional side view taken along the line II—II in FIG. 1.

As shown in FIG. 2, each holder 4 supports each head 2*a* of the ignition coil 2 individually, and hooks on the base plate 3. The coil-head 2*a* is formed to be larger than the coil-body 2*b* and a plug hole 5*b* of the engine head cover 5 in diameter. The coil-body 2*b* is inserted into the plug hole 5*b* coaxially. Each coil-body 2*b* is inserted into each clearance hole 4*a* of the holder 4. The ignition coil 2 is mounted on the holder 4 and the engine head cover 5, and is pressed downward by the base plate 3 on top end surface of the coil-head 2*a*. The plug-cap 2*c* is under the coil-body 2*b*, and is a cylindrical member made of elastic material such as rubber.

When the ignition coil 2 is inserted into the plug hole 5*b*, the plug-cap 2*c* fits onto the top end of the ignition plug 6 with the inner peripheral surface of the plug-cap 2*c*, and the ignition coil 2 is electrically connected with the ignition plug 6 at respective end connectors. The plug-cap 2*c* hooks on an internal portion of the coil-body 2*b*, and is fixed so that the plug-cap 2*c* is not pulled off the coil-body 2*b*. Thus, when the ignition coil 2 is pulled out of the plug hole 5*b*, the plug-cap 2*c* is drawn out with the coil-body 2*b* all together. The plug-cap 2*c* is not left on the ignition plug 6 in the plug hole 5*b*.

Figure 3:
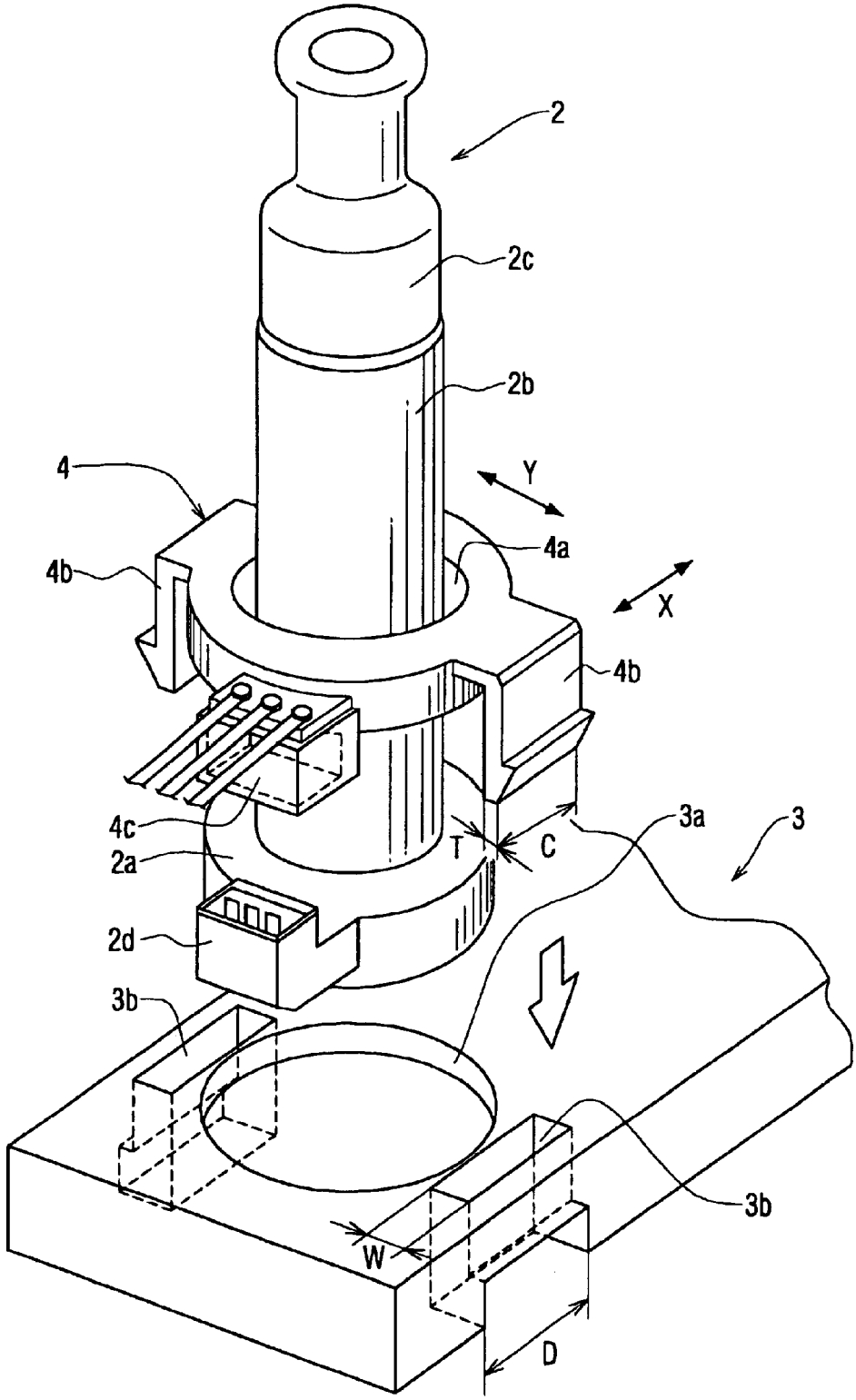
FIG. 3 is an exploded perspective view of the ignition coil apparatus.

As shown in FIG. 3, the base plate 3 is a long flat board, and is made of non-conductive resin or the like. At each receiving surface of the coil-head 2*a*, a recess 3*a* is formed. Each recess 3*a* is shaped approximately circularly, and receives each top end surface of the ignition coil-head 2*a*. The center distance between the centers of neighboring recesses 3*a* is designed to be equal to the center distance between the centers of neighboring plug holes 5*b* at the engine head cover 5. At both peripheral ends of the circular recess 3*a*, a pair of insertion openings (hooking slots 3*b*) 3*b* is formed to oppose each other across the center of the recess. At both peripheral ends of the holder 4, a pair of the hooking claws 4*b* is protrusively formed to be received by the hooking slots 3*b* in snap-fitting direction with the base plate 3.

The holder 4 has a molded connector (supply-connector 4*c*) 4*c* to be wired with an outer section such as an ECU and a battery. The coil-head 2*a* has another connector (coil-connector 2*d*) 2*d*, which protrudes on peripheral side thereof, and is wired with the plug-cap 2*c* internally. The coil-connector 2*d* is connected with the supply-connector 4*c*.

In assembling, the base plate 3 is set so as the bottom surface of the recess 3*a* face upward. The four ignition coils 2 are set on the base plate 3 so that each end surface of the coil-head 2*a* contacts each bottom surface of each recess 3*a*, and the coil-head 2*a* is received by the recess 3*a*. The holder 4 is set on the coil-head 2*a* inserting the coil-body 2*b* into its clearance hole 4*a*. The supply-connector 4*c* is press-fitted onto the coil-connector 2*d*, and electrically connected. Simultaneously, the hooking claws 4*b* are snap-fitted into the hooking slots 3*b*, and are hooked on. Thus, the ignition coils 2 are assembled on the base plate 3, being supported by the holders 4.

The supply-connector 4*c* fits onto the coil-connector 2*d* without clearance, so the ignition coil 2 and the holder 4 are joined without looseness. Here, the length D of the hooking slot 3*b* is designed larger than the length C of the hooking claw 4*b*. The holder 4 is assembled on the base plate 3 with clearance (movable-clearance), in which the claw 4*b* is movable within the slot 3*b*, in the longitudinal direction X of the base plate 3. The width W of the hooking slot 3*b* is designed to be larger than the thickness T of the hooking claws 4*b*. The holders 4 are set on the base plate 3 with movable-clearance in the width direction Y.

Furthermore, as shown FIG. 2, the diameter A of the recess 3*a* is designed to be larger than the diameter B of the coil-head 2*a*. The top surface of the coil-head 2*a* is received in each recess 3*a* with clearance. As shown in FIG. 3, the coil-head 2*a* can be slid on the bottom of the recess 3*a* in both width direction Y and longitudinal direction X. The coil-head 2*a* can be displaced within the movable-clearance between the hooking claw 4*b* and the hooking slot 3*b*, and between the coil-head 2*a* and the recess 3*a*.

In FIG. 1, the relative position among the ignition coil 2, the base plate 3 and plug holes 5*b* can be adjusted in the plane perpendicular to the axial direction of the ignition coil 2 absorbing misalignment. By the sliding adjustment, the ignition coils 2 can be inserted into the plug holes 5*b* and coaxially. The adjustment structure absorbs not only the plug-pitch error, but also manufacturing error of the boring positions of the plug holes 5*b* in the longitudinal direction X and width direction Y of the base plate 3. Thus, manufacturing tolerance of the relative position of the plug holes 5*b* can be eased.

Even in case that, attachment of the ignition coil apparatus 1 on the engine cover 5 is misaligned, residual stress is relieved by the adjustable structure. Thus, troubles due to fatigue fracture such as inner disconnection can be reduced.

Furthermore, each ignition coil 2 can be replaced individually by disassembling each holder 4 from the base plate 3. The ignition coil 2 can be electrically-connected easily with the ECU, battery and so on via the coil-connector 2*d* and the supply-connector 4*c*.

All of the ignition coils 2 can be integrated into one piece, and can be set on the engine cover 5 at one time.

The present invention is not limited to the above embodiment, and includes variations.

The hooking slots 3*b* can be formed in the holder 4, and the hooking claws 4*b* can be formed on the base plate 3.

Figure 4:
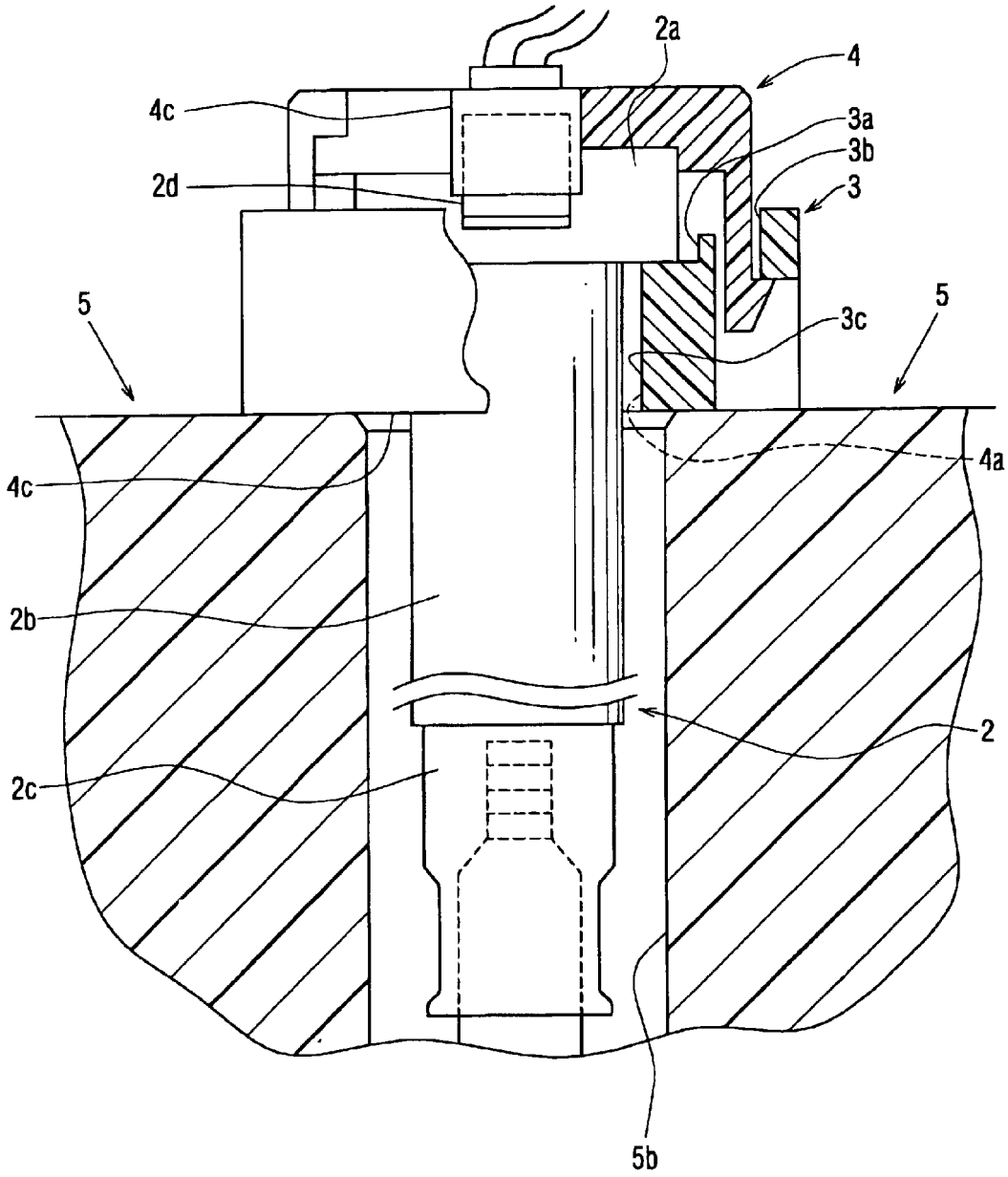
FIG. 4 is an enlarged partially cross-sectional side view of the ignition coil apparatus mounted on the engine head cover.
Figure 5:
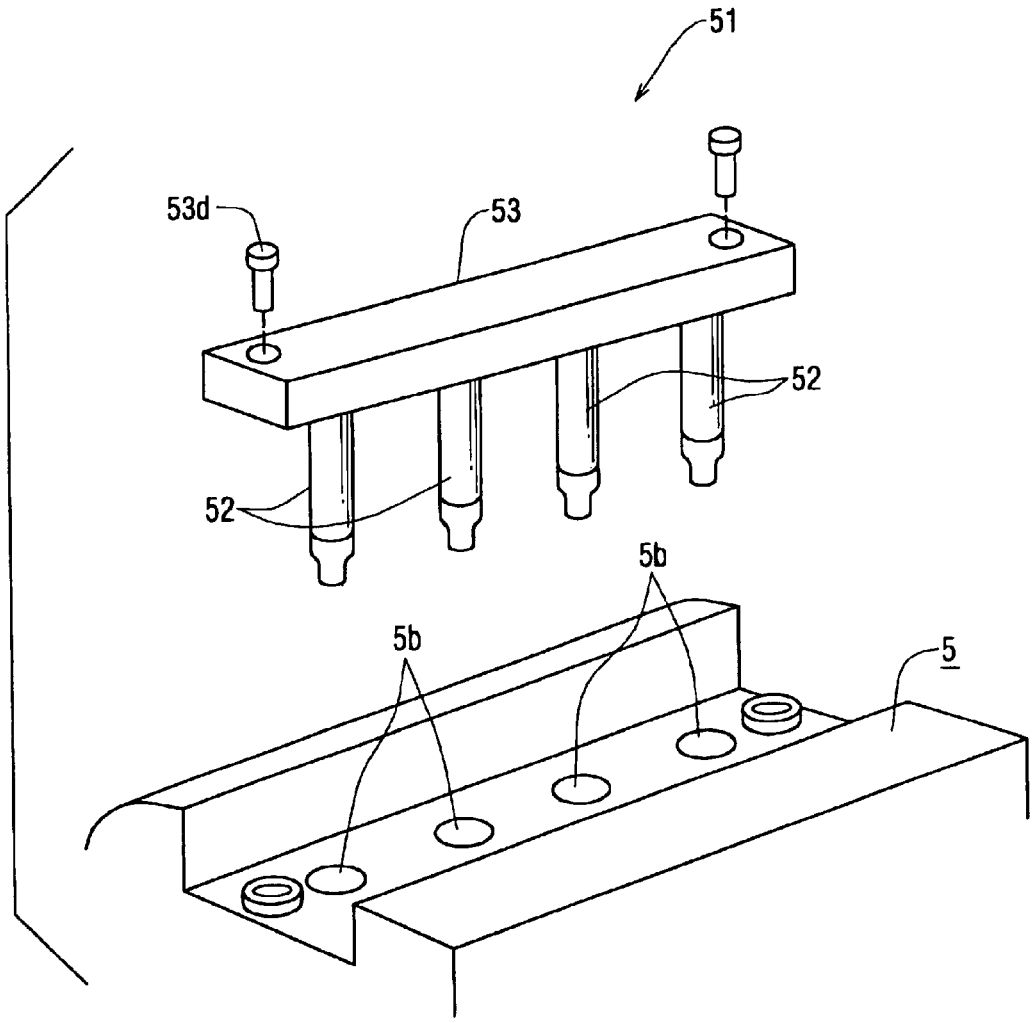
FIG. 5 RELATED ART
FIG. 5 is a perspective view of an integrated ignition coil apparatus according to a related art.

Further as shown in FIG. 4, the base plate 3 can have a through hole as a clearance hole 3*c*. In this case, the holder 4 does not have the clearance hole, and is closed at the top end. The coil-body 2*b* is inserted into the clearance hole 3*c* of the base plate 3 from upward. Each ignition coil 2 hooks on the top surface of the base plate 3 around the clearance hole 4*a* at the bottom surface of the coil-head 2*a*. Then, the holder 4 is set from upward of the coil-head 2*a*. Each assembly thus has clearances between the holder 4 and the base plate 3 so that the position of the ignition coil 2 relative to the plug hole 5*b* is adjustable. The coil-heads 2*a* can be supported by the holders 4 and the base plate 3, and the plural ignition coils 2 are assembled with the base plate 3 into one piece.

The hooking claws 4*b* need not necessarily be opposing pair claws. The number of the claws 4*b* and relative position of the claws 4*b* can be varied, as far as the holder 4 can be hooked on the base plate 3.

Connection between the holder 4 and the base plate 3 need not necessarily be a snap-fitting structure, as far as displacement of the holder 4 is restricted by the base plate 3.

The recesses 3*a* are not necessarily needed. Without the recesses, the ignition coils 2 can be movably supported by the base plate 3 and the holder 4 with clearance. The recesses 3*a* are preferably formed for assembly work to set the coil-heads 2*a* at the predetermined position and restricting each displacement of the coil head 2*a* within the recess.

The supply-connectors 4*c* can be formed at the base plate 3 instead of each holder 4. In this case, the supply-connectors 4*c* are built on the base plate 3 with movable-clearance. When each ignition coil 2 is set on the base plate 3, the supply-connector. 4*c* is electrically connected with the coil-connector 2*d* of the coil-head 2*a*. Subsequently, the holder 4 is set on each coil-head 2*a*.

What is claimed is:

1. An ignition coil apparatus for an engine having a plug hole comprising:

an ignition coil including a body section accommodated in the plug hole of the engine, and a head section mounted out of the plug hole and having a wider part than the body section;

a holder supporting the head section; and a plate supporting the head section with the holder, wherein:

the head section has a first electrical connector; and one of the holder and the plate has a second electrical connector to be connected with the first electrical connector.

2. An ignition coil apparatus according to claim 1, wherein:

the holder has a hole to receive the body section of the ignition coil and receives the head section against the engine; and the plate presses the head section of the ignition coil toward the engine.

3. An ignition coil apparatus according to claim 1, Wherein:

the plate has a hole to receive the body section of the ignition coil and receives the head section against the engine; and the holder is set at the head section of the ignition coil toward the engine.

4. An ignition coil apparatus according to claim 1, wherein the plate has a recess, which is wider than the head section, to movably receive the head section of the ignition coil.

5. An ignition coil apparatus according to claim 1, wherein:

one of the holder and the plate has a protrusion;

an other of the holder and the plate has an opening, and the protrusion and the opening are movably engaged each other.

6. An ignition coil apparatus according to claim 1, wherein the plate has a plurality of recesses, each of which supports the ignition coil with the holder individually.

7. An ignition coil apparatus according to claim 1, wherein:

the plate has a plurality of recesses, each of which supports the ignition coil with the holder, and the plurality of the ignition coils are set on the plate to be one piece.

8. An ignition coil apparatus according to claim 1, wherein an assembled structure of the holder and the ignition coil includes electrical connection of the first connector and the second connector itself.

9. An ignition coil apparatus for an engine having a plurality of plug holes, the apparatus comprising:

a single elongated plate;

a plurality of ignition coils for insertion in the plug holes, each of the ignition coils including a cylindrical body section and a head section; and a plurality of holders detachably engaged with the elongated plate and movably holding the ignition coils to the elongated plate, each holder supporting the head section against the elongated plate in a longitudinal direction of the body section while allowing the head section to move in a radial direction of the body section.

10. An ignition coil apparatus according to claim 9, wherein:

the head section has a first electrical connector;

one of the holder and the elongated plate has a second electrical connector; and the connectors are positioned to be connected automatically when the holder is engaged with the elongated plate.

11. An ignition coil apparatus according to claim 9, wherein:

the head section is larger in diameter than the body section;

one of the elongated plate and the holder has a through hole larger in diameter than the body section and smaller in diameter than the head section thereby to movably receive the body section therein; and the head section is disposed between the elongated plate and the holder.

12. An ignition coil apparatus according to claim 11, wherein:

the other of the elongated plate and the holder has a recess larger in diameter than the head section thereby to movably receive the head section therein.

13. An ignition coil apparatus according to claim 9, wherein:

one of the elongated plate and the holder has a slot; and the other of the elongated plate and the holder has a claw detachably hooked in the slot of the elongated plate.

14. An ignition coil apparatus according to claim 13, wherein:

the slot is larger than the claw thereby to allow the claw to move in a longitudinal direction of the elongated plate.

* * * * *